US007998388B2

(12) United States Patent
Marin et al.

(10) Patent No.: US 7,998,388 B2
(45) **Date of Patent: *Aug. 16, 2011**

(54) ROTARY PROCESS FOR FORMING UNIFORM MATERIAL

(75) Inventors: Robert Anthony Marin, Midlothian, VA (US); Larry R. Marshall, Chesterfield, VA (US); Amanda Dawn Miller, Avondale, PA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/465,905

(22) Filed: May 14, 2009

(65) Prior Publication Data

US 2009/0218719 A1 Sep. 3, 2009

Related U.S. Application Data

(62) Division of application No. 11/096,996, filed on Apr. 1, 2005, now Pat. No. 7,582,240.

(60) Provisional application No. 60/558,748, filed on Apr. 1, 2004.

(51) Int. Cl.
*D01D 5/11* (2006.01)

(52) U.S. Cl. ..... 264/205; 264/173.1; 264/175

(58) Field of Classification Search ..... 264/173.1, 264/205, 175

See application file for complete search history.

(56) References Cited

U.S. PATENT DOCUMENTS 7,118,698 B2 * 10/2006 Armantrout et al. ..... 264/205
2004/0219345 A1 * 11/2004 Armantrout et al. ..... 428/219

* cited by examiner

*Primary Examiner* — Christina Johnson
*Assistant Examiner* — Larry Thrower

(57) ABSTRACT

A thin, uniform membrane comprising polymeric fibrils or a combination of fibrils and particles, wherein the fibrils have randomly convoluted cross-sections, and a process for making the membrane are disclosed. The membrane may be on the surface of a substrate as part of a composite sheet, or as a stand-alone structure.

8 Claims, 4 Drawing Sheets

ROTARY PROCESS FOR FORMING UNIFORM MATERIAL

FIELD OF THE INVENTION

The present invention relates to the field of issuing material from a rotating rotor and collecting a portion of the material in the form of fibrous nonwoven sheet or membrane comprising discrete fibrils or combinations of discrete fibrils and discrete particles.

BACKGROUND OF THE INVENTION

Flash spinning is an example of a spray process having very high issuance speed. Flash spinning processes involve passing a fiber-forming substance in solution with a volatile fluid, referred to herein as a "spin agent," from a high temperature, high pressure environment into a lower temperature, lower pressure environment, causing the spin agent to be flashed or vaporized, and producing materials such as fibers, fibrils, foams or plexifilamentary film-fibril strands or webs. The temperature at which the material is spun is above the atmospheric boiling point of the spin agent so that the spin agent vaporizes upon issuing from the nozzle, causing the polymer to solidify into fibers, foams or film-fibril strands. Conventional flash spinning processes for forming web layers of plexifilamentary film-fibril strand material are disclosed in U.S. Pat. Nos. 3,081,519 (Blades et al.), 3,169,899 (Steuber), and 3,227,784 (Blades et al.), 3,851,023 (Brethauer et al.). However, the web layers formed by these conventional flash spinning processes are not entirely uniform.

SUMMARY OF THE INVENTION

The present invention is directed to a membrane comprising randomly convoluted cross-sectioned polymeric fibrils, the membrane having a thickness of less than or equal to about 50 μm, and a machine direction uniformity index of less than or equal to about 29 $(g/m^2)^{1/2}$.

In another embodiment, the present invention is directed to a process comprising the steps of (a) supplying a fluidized mixture comprising a spin agent and at least two polymers having different melting or softening temperatures at a pressure greater than atmospheric pressure to a rotor spinning about an axis at a rotational speed, the rotor having at least one material-issuing nozzle comprising an opening therein along the periphery of the rotor; (b) issuing the fluidized mixture from the opening of the nozzle into an environment at atmospheric pressure to form an issued material at a material issuance speed; (c) vaporizing or expanding at least one component of the issued material to form a fluid jet; (d) transporting the remaining component(s) of the issued material away from the rotor by the fluid; (e) collecting the remaining component(s) of the issued material on a collection surface of a collection belt concentric to the axis of the rotor to form a collected material, the collection belt moving in a direction parallel to the axis of rotation of the rotor at a collection belt speed; and (f) maintaining the temperature of the collected material at a temperature greater than the temperature of the lowest melting or softening temperature polymer for a sufficient time to render the lowest melting or softening temperature polymer tacky.

In another embodiment, the present invention is directed to a process for forming a material comprising discrete fibrils, the process comprising the steps of (a) supplying the fluidized mixture comprising a solution of a polymer in a spin agent at a concentration of about 0.5% by weight to about 5% by weight at pressures greater than atmospheric pressure to a rotor spinning about an axis at a rotational speed, the rotor having a material-issuing nozzle comprising an opening therein along the periphery of the rotor; (b) issuing the fluidized mixture from the opening of the nozzle into an environment at atmospheric pressure to form an issued material at a material issuance speed; (c) vaporizing or expanding at least one component of the issued material to form a fluid jet; (d) transporting discrete fibrils formed from the remaining component(s) of the issued material away from the rotor by the fluid; and (e) collecting the discrete fibrils on a collection surface of a collection belt concentric to the axis of the rotor to form a membrane having a thickness of less than or equal to about 50 μm, the collection belt moving in a direction parallel to the axis of rotation of the rotor at a collection belt speed.

In another embodiment, the present invention is directed to a process comprising the steps of (a) supplying two separate fluidized mixtures comprising different polymer components at pressures greater than atmospheric pressure to a rotor spinning about an axis at a rotational speed, the rotor having at least two separate material-issuing nozzles, each nozzle comprising an opening therein along the periphery of the rotor; (b) issuing the two separate fluidized mixtures from the openings of the separate nozzles into an environment at atmospheric pressure to form a separate issued material at a material issuance speed from each nozzle; (c) vaporizing or expanding at least one component of each separate issued material to form a fluid jet; (d) transporting the remaining component(s) of each separate issued material away from the rotor by the fluid; and (e) collecting the remaining component(s) of each separate issued material on a collection surface of a collection belt concentric to the axis of the rotor to form a collected material, the collection belt moving in a direction parallel to the axis of rotation of the rotor at a collection belt speed.

DEFINITIONS

The terms "jet" and "fluid jet" are used herein interchangeably to refer to an aerodynamic moving stream of fluid including gas, air or steam. The terms "carrying jet" and "material-carrying jet" are used herein interchangeably to refer to a fluid jet transporting material in its flow.

The term "machine direction" (MD) is used herein to refer to the direction of movement of a moving collection surface. The "cross direction" (CD) is the direction perpendicular to the machine direction.

The term "polymer" as used herein, generally includes but is not limited to, homopolymers, copolymers (such as for example, block, graft, random and alternating copolymers), terpolymers, etc., and blends and modifications thereof. Furthermore, unless otherwise specifically limited, the term "polymer" shall include all possible geometric configurations of the molecules, including but not limited to isotactic, syndiotactic and random symmetries.

The term "polyolefin" as used herein, is intended to mean any of a series of largely saturated polymeric hydrocarbons composed only of carbon and hydrogen. Typical polyolefins include, but are not limited to, polyethylene, polypropylene, polymethylpentene and various combinations of the monomers ethylene, propylene, and methylpentene.

The term "polyethylene" as used herein is intended to encompass not only homopolymers of ethylene, but also copolymers wherein at least 85% of the recurring units are ethylene units such as copolymers of ethylene and alpha-olefins. Preferred polyethylenes include low density polyethylene, linear low density polyethylene, and linear high density polyethylene. A preferred linear high density polyethylene has an upper limit melting range of about 130° C. to 140° C., a density in the range of about 0.941 to 0.980 gram per cubic centimeter, and a melt index (as defined by ASTM D-1238-57T Condition E) of between 0.1 and 100, and preferably less than 4.

The term "polypropylene" as used herein is intended to embrace not only homopolymers of propylene but also copolymers where at least 85% of the recurring units are propylene units. Preferred polypropylene polymers include isotactic polypropylene and syndiotactic polypropylene.

The term "spin agent" is used herein to refer to a volatile fluid in a polymeric solution capable of being flash spun.

The term "membrane" is used herein to refer to a thin, uniform sheet material of a thickness less than 50 micrometers.

The terms "fibril" and "discrete fibril" are used herein interchangeably to refer to a discontinuous strand of polymer having a randomly convoluted cross-section.

BRIEF DESCRIPTION OF THE DRAWINGS

The accompanying drawings, which are incorporated in and constitute a part of this specification, illustrate the presently preferred embodiments of the invention and, together with the description, serve to explain the principles of the invention.

DETAILED DESCRIPTION OF THE INVENTION

Figure 1:
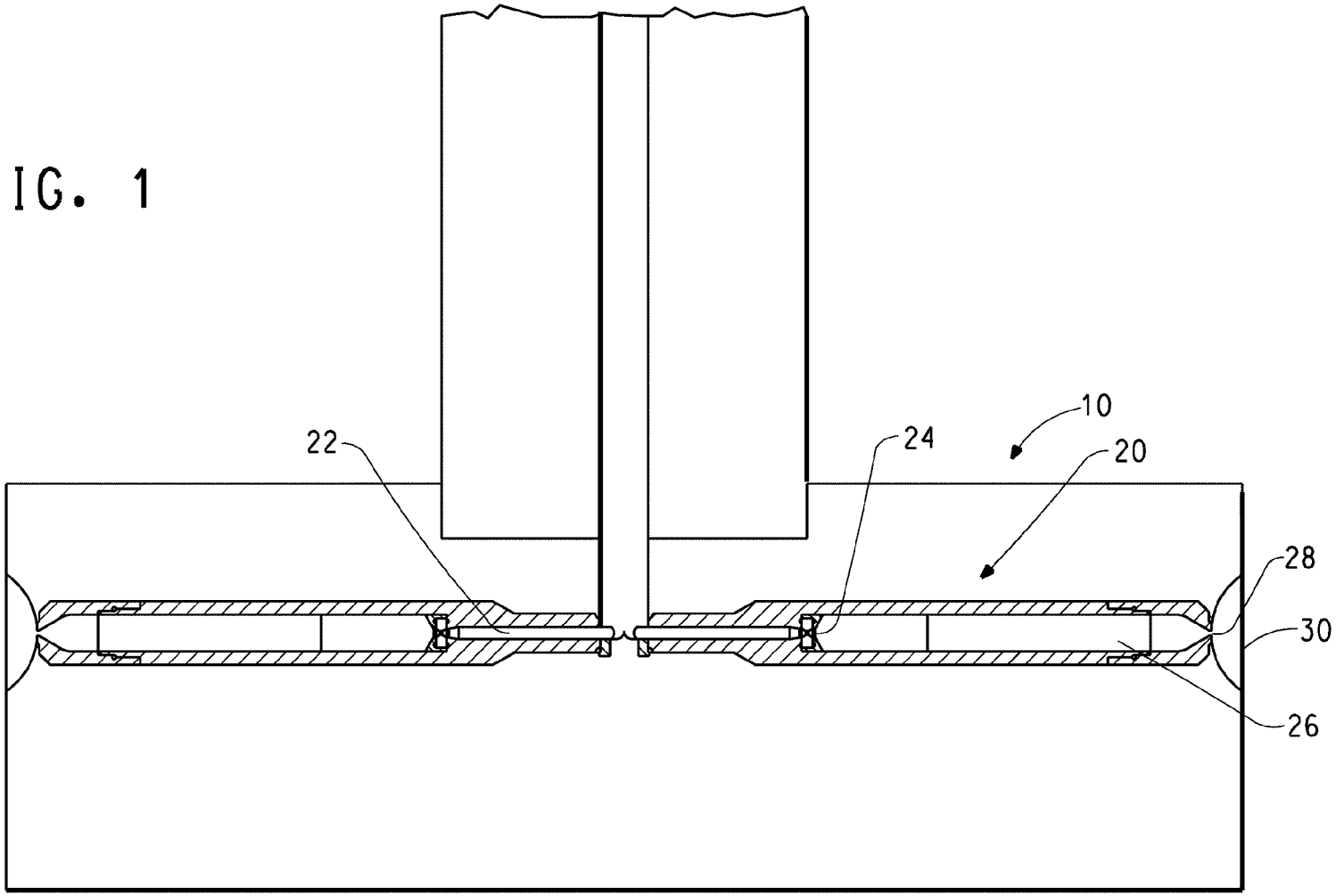
FIG. 1 is a cross-section of a rotor used in the process of the invention.

Reference will now be made in detail to the presently preferred embodiments of the invention, examples of which are illustrated in the accompanying drawings. Throughout the drawings, like reference characters are used to designate like elements.

One difficulty with conventional flash spinning processes is in attempting to collect the web layers in a perfectly spread state and at the speed at which they are moving, which might result in a product with excellent uniformity of thickness and basis weight. In conventional processes, the speed at which the solution is propelled from the nozzles, which is also the speed at which the web layers are formed, is on the order of 300 kilometers per hour, depending on the molecular weight of the spin agent, while the web layers are typically collected on a belt moving at a speed of 8-22 kilometers per hour. Some of the slack introduced into the process by the difference between the web formation speed and the web take-up speed is taken up by oscillating the web layers in the cross-machine direction; however, this does not result in uniformly deposited discrete fibrils.

The present inventors have developed a process that results in more uniform deposition of sprayed particulates, in particular discrete fibrils or a combination of discrete fibrils and discrete polymer particles having improved uniformity of distribution and of basis weight.

The present inventors have developed a process in which the speed of collection of discrete fibrils or a combination of discrete fibrils and discrete polymer particles issued or "spun" from a nozzle by way of a fluid jet more closely matches the speed at which the fibrils or discrete fibrils and discrete particles are issued, as well as a process for forming material in the form of a fibrous sheet material or a membrane by issuing a fluidized mixture from a rotating nozzle by way of a fluid jet and collecting the solids formed thereby at a speed which approximates the speed at which they are issued.

In the process of the present invention, a fluidized mixture comprising at least two components is supplied to a nozzle located in a rotor rotating about an axis. The fluidized mixture is supplied to the nozzle at a pressure greater than atmospheric pressure. The fluidized mixture is issued or "spun" at high speed from an opening in the nozzle to form an issued material. The exact form of the nozzle will depend on the type of material being issued and the desired product. The nozzle has an inlet end for receiving the fluidized mixture and an outlet end opening to the outer periphery of the rotor for issuing the mixture as the issued material. Upon issuing from the outlet end of the nozzle into the lower pressure environment surrounding the rotor, one of the components of the issued material is immediately either converted to vapor phase or rapidly expanded if already in vapor phase and the remaining component(s) of the issued material are solidified and propelled from the nozzle. Preferably, at least one-half of the mass of the fluidized mixture is vaporized, or expanded as a vapor upon issuing from the nozzle.

The remaining component(s) of the issued material, that is the solidified material that does not vaporize immediately upon being issued, also referred to herein as the "solidified material," can take the form of discrete fibrils or a combination of discrete fibrils and discrete polymer particles. The solidified material is transported away from the rotor by a high speed fluid jet that originates in the rotor, formed by the rapid flashing or expanding of the vaporizing component of the fluidized mixture. The fluid jet can comprise steam, air or other gas, including flashing spin agent. The speed of the fluid jet carrying the solidified material as it issues from the rotor is at least about 100 feet per second (30 m/s), preferably greater than about 200 feet per second (61 m/s). The solidified material is collected by a means appropriate for the form of the material and the desired product. When a sheet material is desired, a collector is used that is a concentric collection surface spaced a certain distance from the rotor. The collection surface can be located a distance of about twice the thickness of the collected material on the collection surface to about 15 cm from the nozzle. Advantageously, the collection surface is located a distance of about 0.5 cm to about 8 cm from the nozzle. The collection surface can be a moving belt, or a collection surface conveyed by a moving belt. The collector can be a moving collection belt, a stationary cylindrical structure, a collecting substrate being conveyed by a moving belt or a collection container, as appropriate for the particular material being collected. When the issued material is collected on a collection surface, the solidified component(s) of the issued material separate from the fluid jet, or the vaporizing component of the issued material, and remain on the collection surface of the collection belt.

The material is flash spun through the nozzle to form discrete fibrils or a combination of discrete fibrils and discrete particles. The conditions required for flash spinning are known from U.S. Pat. Nos. 3,081,519 (Blades et al.), 3,169,899 (Steuber), 3,227,784 (Blades et al.), 3,851,023 (Brethauer et al.), the contents of which are hereby incorporated by reference.

A fluidized mixture comprising a polymeric solution of a polymer and a spin agent is supplied to the inlet of the nozzle at a temperature greater than the boiling point of the spin agent and at a pressure sufficient to keep the mixture in the liquid state. FIG. 1 is a cross-sectional view of a rotor 10 for use in the process of the present invention that includes a nozzle 20. The nozzle includes a passage 22 through which the polymeric solution is supplied to a letdown orifice 24. The letdown orifice 24 opens into a letdown chamber 26 for holding the polymer solution at a letdown pressure lower than its cloud point to enter a region of two phase separation of polymer and spin agent. The letdown chamber leads to a spin orifice 28 that opens to the outlet or opening of the nozzle. The polymer-spin agent mixture is issued from the nozzle, preferably at a temperature above the boiling temperature of the spin agent. The environment into which the mixture is issued is preferably within about 40° C. of the boiling temperature of the spin agent, more preferably within about 10° C. of the boiling temperature of the spin agent, and at a pressure that is reduced relative to the supply pressure at the nozzle inlet.

Material is issued from the nozzle(s) 20 assisted by a fluid jet, also referred to herein as a "carrying jet," which begins expanding within the nozzle and continues expanding upon issuing from the nozzle, and which carries and propels the issued material at high speed away from the outlet of the nozzle. The jet begins as laminar flow and decays into turbulent flow at some distance from the outlet of the nozzle. The form of the issued material itself will be determined by the type of fluid flow of the jet. If the jet is in laminar flow, the issued material will be much more evenly spread and distributed than if the jet is in turbulent flow, thus it is desirable to collect the issued material prior to the onset of turbulent flow.

The issuance speed of the material can be controlled by varying the pressure and temperature at which the material is issued by the jet and the design of the opening through which it is issued.

In flash spinning, the issuance speed at which the material is propelled by the jet varies depending on the spin agent used in the polymeric solution. It has been observed that the higher the molecular weight of the spin agent, the lower the issuance speed of the jet. For example, using trichlorofluoromethane as the spin agent in the polymeric solution has been found to result in a jet issuance speed of about 150 m/s, while using pentane which has a lower molecular weight as the spin agent has been found to result in a jet issuance speed of about 200 m/s. The speed of the issuing material in the radial direction away from the rotor is determined primarily by the jet issuance speed and not by the centrifugal force caused by the rotation of the rotor.

Referring to FIG. 1, the outlet end of the nozzle 20 can optionally comprise a slotted outlet, also referred to herein as a "fan jet," as described in U.S. Pat. No. 5,788,993 (Bryner et al.), the contents of which are hereby incorporated by reference. The fan jet is defined by two opposing faces 30 immediately downstream of the spin orifice 28. The use of such a fan jet causes the material-carrying jet being issued through the spin orifice to spread across the width of the slot. The fluid jet spreads the material in different directions as determined by the orientation of the slot. According to one embodiment of the present invention, the slot is oriented primarily in the axial direction, causing the material to be spread in the axial direction. This results in an even distribution of material as it is issued. By "primarily in the axial direction" is meant that the long axis of the slot is within 45 degrees of the axis of the rotor. If desired, the slotted outlet of the nozzle 20 can alternatively be oriented in a generally non-axial direction. By "non-axial direction" is meant that the long axis of the slot is at a greater than 45-degree angle from the axis of the rotor.

The nozzle outlet can be directed in a primarily radial or non-radial direction. When the nozzle outlet is directed in the radial direction, the carrying jet is able to transport the issued material farther from the rotor than when the nozzle is directed non-radially. This becomes important when a collector is located a certain distance or gap from the rotor concentric to the rotor and the material must traverse the gap in order to be collected. The nozzle outlet also can be oriented such that it is directed non-radially, in a direction away from the direction of rotation. When this is the case and the issued material is being collected on a concentric collector, the gap between the rotor and the collector should be minimized in order to avoid wrapping of the material around the rotor. In this case, the issuance speed of the jet should approximate the tangential speed at the periphery of the rotor and the gap should be minimized as much as is practical. The advantage of this embodiment of the invention is that the material is collected at nearly the same speed that it is issued, and before the onset of turbulence in the fluid jet. This results in a very uniformly distributed product.

In one embodiment of the present invention, the nozzle outlet can be oriented such that it is directed in the direction of the movement of the collection belt.

In an embodiment of the present invention in which the rotor has multiple nozzles, the nozzles can be spaced apart in the axial direction. The nozzles can be spaced apart from each other such that the material issuing from the nozzles either overlaps or does not overlap with material issuing from adjacent nozzles, depending on the desired product. In one embodiment of the invention, it has been found that when the width of the fan jets is held constant and the distance between the openings is approximately the width of an individual jet multiplied by a whole number, a very uniform product profile results.

Alternatively, the nozzles can be spaced apart circumferentially around the periphery of the rotor. In this way, more layers can be formed without increasing the rotor height.

When fibrous material is issued from fan jets, the jet orientation can impart general fiber alignment that impacts the balance of properties in the machine and cross directions. In one embodiment of the invention in which multiple nozzles are used, a portion of the jets are angled at between 20 and 40 degrees from the axial direction, or the axis of the rotor, and a portion of the jets are angled at the same angle in the opposite direction relative to the axis. Having a portion of the jets oriented at opposite angles from each other relative to the rotor axis provides a resulting product having less directionality and more balance in its properties.

Figure 2:
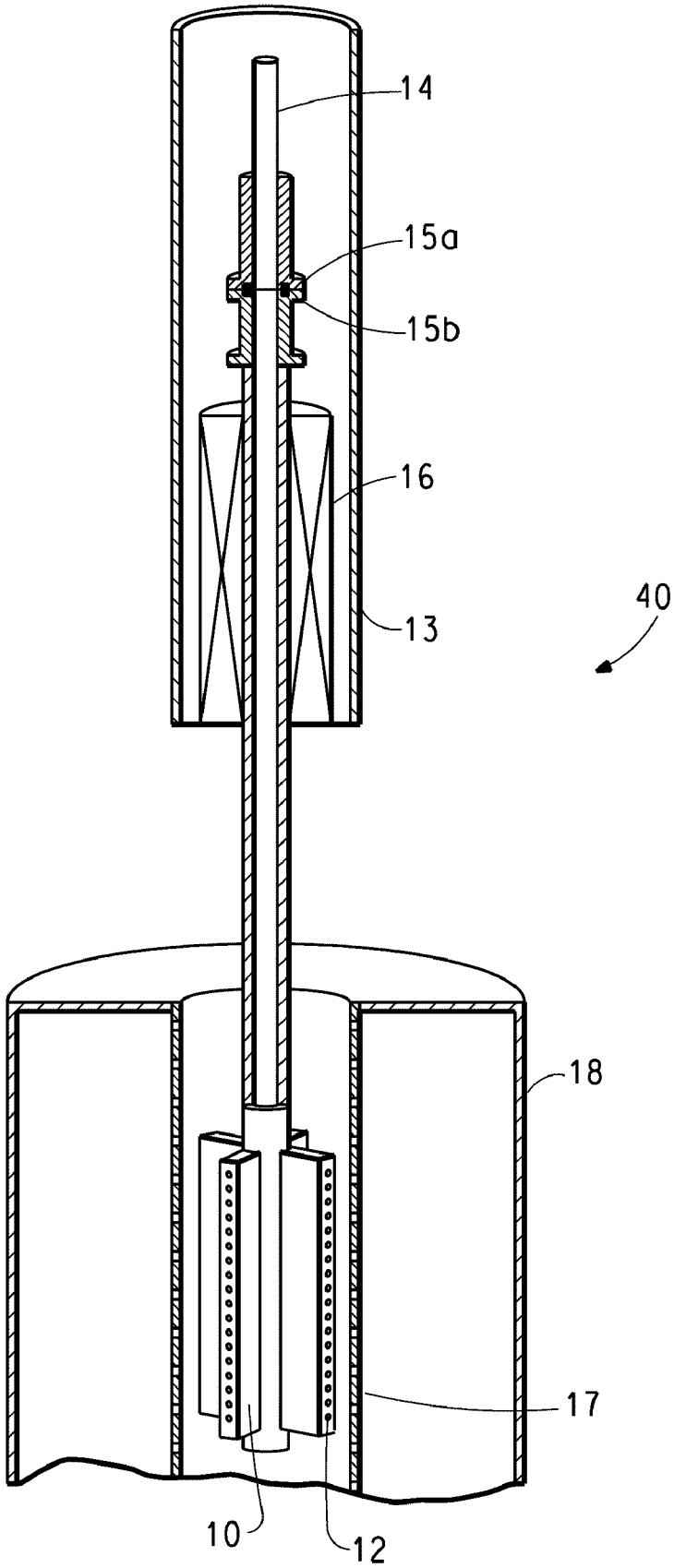
FIG. 2 is a cross-section of an apparatus, including a rotor and a collection surface, used in the process of the invention.

FIG. 2 illustrates one possible configuration of an apparatus 40 for carrying out the process of the invention which includes the rotor body 10 mounted on a rotating shaft 14 supported by a rigid frame 13. The rotating shaft 14 is hollow so that the fluidized mixture can be supplied to the rotor. Along the periphery of the rotor are openings 12 through which the material is issued. The component(s) of the issued material that do not vaporize upon issuing from the nozzle collect on a moving belt (not shown) passing over a porous collector 17. The collector is surrounded with a vacuum box 18 for pulling a vacuum through the porous collector 17, thereby pinning the issued material onto the collection surface of the moving belt. Along the shaft 14 there is a rotary seal comprising a stationary portion 15*a* and a rotating portion 15*b*, and a bearing 16.

The nozzle design can affect the distribution of mass issuing from the nozzle and thereby contribute to the uniformity of material laydown. The spreading of the fluid jet results in the spreading of the issued, solidified fibrils or fibrils and particles.

When the material being issued comprises a polymer, the temperature of the nozzle is preferably maintained at a level at least as high as the melting temperature or softening point of the polymer. The nozzle can be heated by any known method, including electrical resistance, heated fluid, steam or induction heating.

The carrying jets issuing from the nozzles can be free or unconstrained on one side, free on both sides, or constrained on both sides for a certain distance upon issuing from the nozzles. The jets can be constrained on one or both sides by plates installed parallel to the outlet slot of the nozzle, preferably "upstream" to or in advance of the slot, from a stationary vantage point outside the rotor relative to the rotation of the rotor. These act as coanda foils, so that the carrying jet attaches itself to the foil by way of a low pressure zone formed adjacent the foil which guides the jet. In this way, the carrying jet is prevented from mixing with the atmosphere on the side(s) constrained by the foil, as occurs when the jet is free. Thus the use of a foil results in a higher speed jet. This has the same effect as reducing the distance between the nozzle outlet and the collector, in that the material is propelled to the collector before the onset of turbulence in the jet.

The foil can be stationary or can be caused to vibrate. A vibrating foil would enhance product formation since it would help to oscillate at high speed the material being laid down. This would be particularly helpful at lower rotational speeds to counter the overfeed of the issued material. The foil is advantageously as least as wide as the spread width of the web as the web leaves the foil.

Several types of fluidized mixtures can be supplied according to the process of the invention. By "fluidized mixture" is meant a composition in the liquid state or any fluid at greater than its critical pressure, the mixture comprising at least two components. The fluidized mixture can be a homogeneous fluid composition, such as a solution of a solute in a solvent, a heterogeneous fluid composition, such as a mixture of two fluids or a dispersion of droplets of one fluid in another fluid, or a fluid mixture in compressed vapor phase. A fluidized mixture suitable for use in the process of the invention can comprise a solution of a polymer in a spin agent, as described below. The fluidized mixture can comprise a dispersion or suspension of solid particles in a fluid, or a mixture of solid material in a fluid. In another embodiment of the present invention, the material is a solid-fluid fluidized mixture. The process of the invention can be utilized to make paper by supplying a mixture of pulp and water to the rotor and supplying sufficient pressure so that the mixture is propelled from the nozzles to a collector located a certain distance from the rotor. In another embodiment of the present invention, a mixture of a solid material, such as pulp, and a fluid, such as water, is supplied to the rotor at a temperature above the boiling point of the fluid, and at sufficiently high pressure to keep the fluid in liquid state. Upon passing through the nozzle, the fluid vaporizes, propelling and spreading the solid material in the direction of the collection surface. In a preferred embodiment, the environment that the material is propelled into and/or the collection surface is maintained at a temperature near the boiling temperature of the fluid, so that condensation of the fluid is minimized. Advantageously, the environment is maintained at a temperature within about 40° C. of the boiling temperature of the fluid, more advantageously within about 10° C. of the boiling temperature of the fluid. The environment can be maintained above or below the boiling temperature of the fluid.

Polymers which can be utilized in this embodiment of the invention include polyolefins, including polyethylene, low density polyethylene, linear low density polyethylene, linear high density polyethylene, polypropylene, polybutylene, and copolymers of these. Among other polymers suitable for use in the invention are polyesters, including poly(ethylene terephthalate), poly(trimethylene terephthalate), poly(butylene terephthalate) and poly(1,4-cyclohexanedimethanol terephthalate); partially fluorinated polymers, including ethylene-tetrafluoroethylene, polyvinylidene fluoride and ECTFE, a copolymer of ethylene and chlorotrifluoroethylene; and polyketones such as E/CO, a copolymer of ethylene and carbon monoxide, and E/P/CO, a terpolymer of ethylene, polypropylene and carbon monoxide. Polymer blends can also be used in the nonwoven sheet of the invention, including blends of polyethylenes and polyesters, and blends of polyethylenes and partially fluorinated fluoropolymers. All of these polymers and polymer blends can be dissolved in a spin agent to form a solution that is then flash spun into nonwoven sheets of plexifilamentary film-fibrils. Suitable spin agents include chlorofluorocarbons and hydrocarbons. Suitable spin agents and polymer-spin agent combinations which can be employed in the present invention are described in U.S. Pat. Nos. 5,009,820; 5,171,827; 5,192,468; 5,985,196; 6,096,421; 6,303,682; 6,319,970; 6,096,421; 5,925,442; 6,352,773; 5,874,036; 6,291,566; 6,153,134; 6,004,672; 5,039,460; 5,023,025; 5,043,109; 5,250,237; 6,162,379; 6,458,304; and 6,218,460, the contents of which are hereby incorporated by reference. In this embodiment of the invention, the spin agent is at least about 90% by weight of the polymer-spin agent mixture, or at least about 95% by weight of the mixture, and even at least about 99.5% by weight of the mixture.

In order to make membranes comprising discrete fibrils or discrete fibrils in combination with discrete polymer particles, the fluidized mixture is a solution of a polymer or polymer blend dissolved in a spin agent, the solution having a concentration low enough that discrete fibrils will be issued from the nozzle(s), typically having a concentration of between about 0.5% by weight and about 5% by weight, depending on the particular polymer(s) and spin agents used. While not wishing to be bound by theory, the present inventors believe that in order for discrete fibrils to form, the polymer phase in the letdown chamber of the nozzle, in which the solution separates into polymer in spin agent phases, is discontinuous.

Obviously, those of skill in the art will recognize that the design of the nozzles 20 (FIG. 1) may need to be changed to accommodate the various embodiments of liquid mixtures discussed above.

Figure 4:
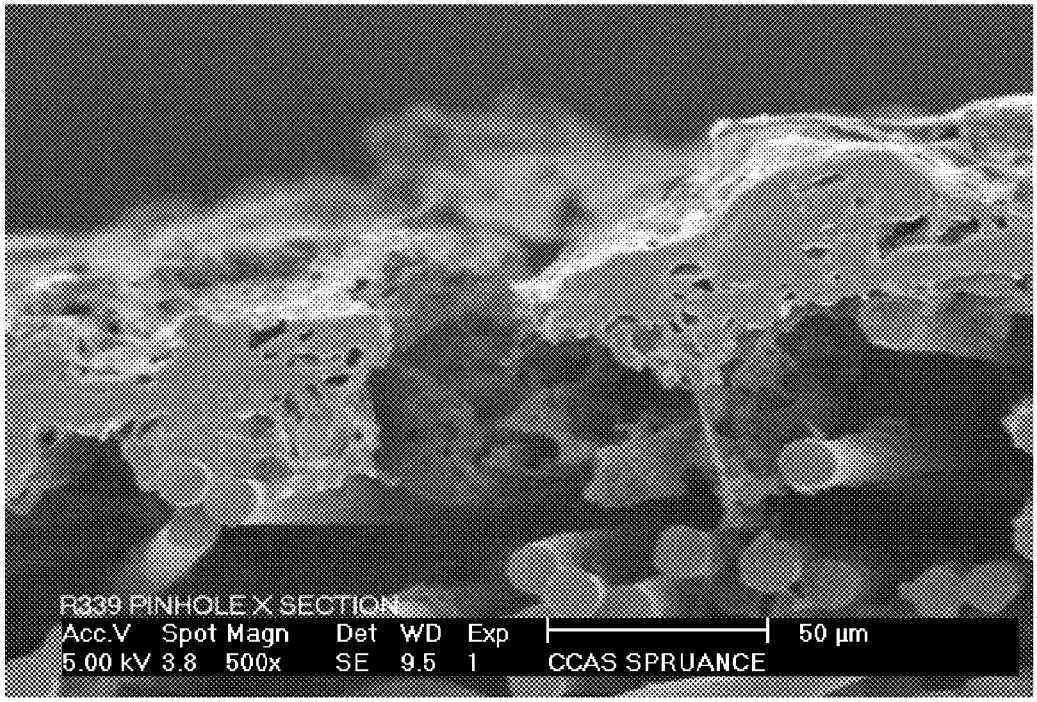
FIG. 4 is a photomicrograph (by scanning electron microscopy) of a cross-section of a composite sheet comprising a membrane layer of discrete fibrils formed by the process of the present invention and a preformed substrate of continuous spunlaced fibers.

Upon being collected on the collection surface or during subsequent processing, the solidified polymeric material can be caused to coalesce to form a porous or non-porous membrane. This material can comprise fibrils or a combination of discrete polymer particles and discrete fibrils. The fibrils of the membrane have randomly convoluted cross-sections, as illustrated in FIG. 4, wherein the convoluted cross-sectional fibrils of the present invention are deposited on a conventional spunlace web of fibers having round cross-sections. The material can also comprise fibrils or a combination of particles and fibrils and foam comprising hollow particles, web, and/or plexifilamentary film-fibril strands. The membrane according to the present invention has a thickness of less than or equal to about 50 micrometers, or less than or equal to about 25 micrometers, or even less than or equal to about 1 micrometer, and a machine direction uniformity index (MD UI) of less than about 5 $(oz/yd^2)^{1/2}$ $(29\ (g/m^2)^{1/2})$, or even less than about 3 $(oz/yd^2)^{1/2}$ $(17\ (g/m^2)^{1/2})$. For comparison, commercially available grades of flash-spun polyolefin sheet sold under the trade name Tyvek® have MD UI of 16-22 $(oz/yd^2)^{1/2}$ (93-128 $(g/m^2)^{1/2}$).

In order to form a highly uniform membrane, the rotational speed of the rotor is greater than about 1000 rpm, or even greater than about 2000 rpm. In order to prevent holes in the membrane, the process is advantageously run with a minimum level of vacuum such that the impact of the pinning forces of the vacuum on the membrane is minimized.

Surprisingly, the membrane made by the process of the invention is porous. If the level of porosity does not provide the desired air permeability, the membrane can be subsequently finished using known means such as calendering. For instance, if a nonporous membrane is desired, the material can be bonded using thermal calendering at a temperature and pressure sufficient to render the membrane nonporous.

In an alternate embodiment of the invention, the solidified issued material is collected at a radial distance from the periphery of the rotor on the interior surface, also referred to herein as the "collection surface," of a concentric collector. The collector can be a stationary cylindrical porous structure made from perforated metal sheet or rigid polymer. The collector can be coated with a friction-reducing coating such as a fluoropolymer resin, or it can be caused to vibrate in order to reduce the friction or drag between the collected material and the collection surface. The cylindrical structure is preferably porous so that vacuum can be applied to the material as it is being collected to assist the pinning of the material to the collector. In one embodiment, the cylindrical structure comprises a honeycomb material, which allows vacuum to be pulled on the collected material through the honeycomb material while providing sufficient rigidity not to deform as a result. The honeycomb can further have a layer of mesh covering it to collect the issued material.

Figure 3:
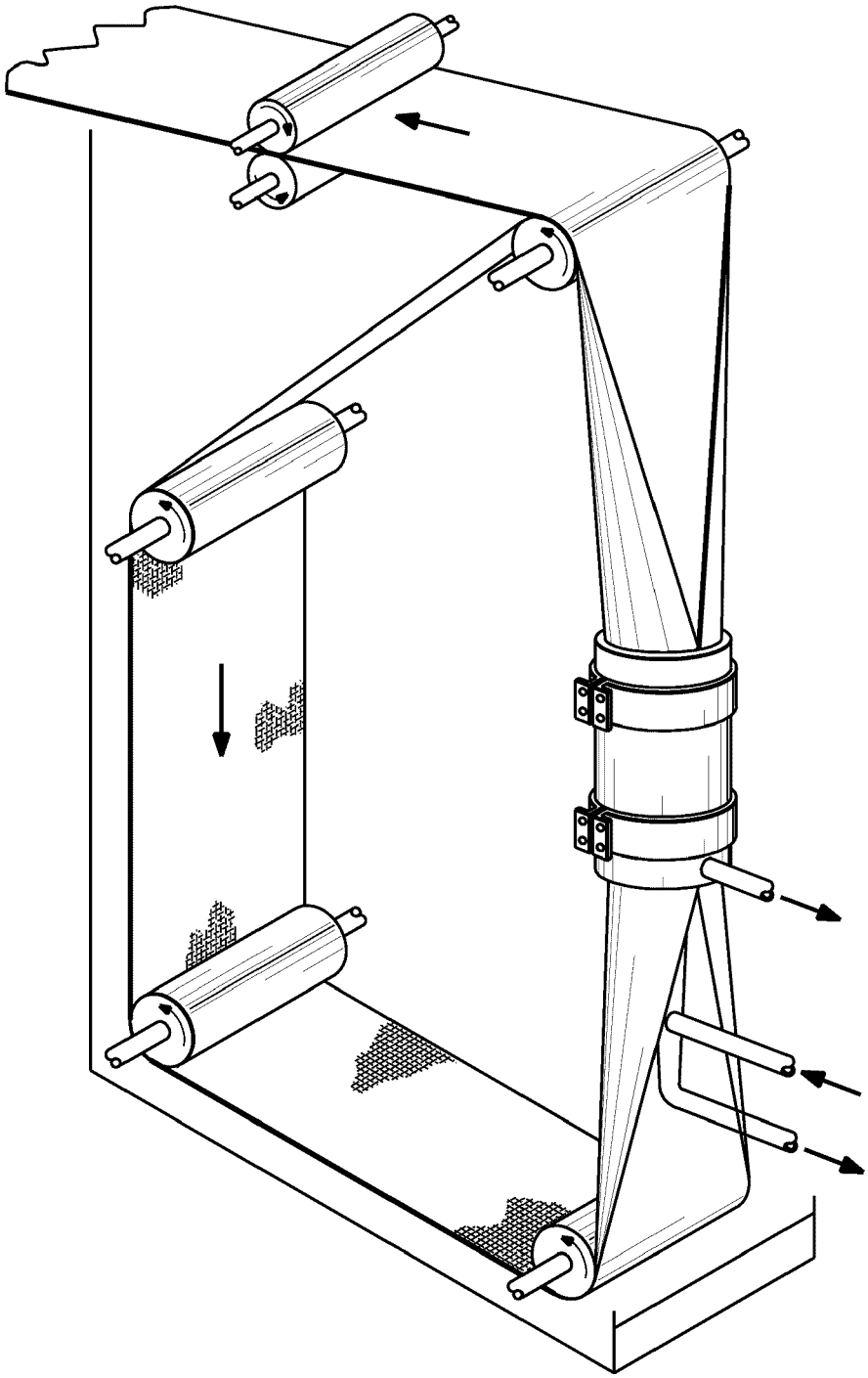
FIG. 3 (PRIOR ART)
FIG. 3 is a perspective drawing illustrating a prior art collection belt suitable for use in the invention.

The collector can alternatively comprise a flexible collection belt moving over a stationary cylindrical porous structure. The collection belt is preferably a smooth, porous material so that vacuum can be applied to the collected material through the cylindrical porous structure without causing holes to be formed in the collected material. The belt can be a flat conveyor belt moving axially to the rotor (in the direction of the axis of the rotor) which deforms to form a concentric cylinder around the rotor and then returns to its flat state upon clearing the rotor, as shown in FIG. 3. In this embodiment of the invention, the cylindrical belt continuously collects the solidified material issuing from the rotor. Such a collection belt is disclosed in U.S. Pat. Nos. 3,978,976 (Kamp), 3,914,080 (Kamp), 3,882,211 (Kamp), and 3,654,074 (Jacquelin).

The collection surface can alternatively further comprise a substrate such as a woven or a nonwoven fabric or a film moving on the moving collection belt, such that the issued material is collected on the substrate rather than directly on the belt. This is especially useful when the material being collected is in the form of a very thin membrane.

The collection surface can also be a component of the desired product itself. For instance, a preformed sheet can be the collection surface and a low concentration solution can be issued onto the collection surface to form a thin membrane on the surface of the preformed sheet. This may be useful for enhancing the surface properties of the sheet, such as printability, adhesion, porosity level, and so on. The preformed sheet can be a nonwoven or woven sheet, or a film. In this embodiment, the preformed sheet can even be a nonwoven sheet formed in the process of the invention itself, and subsequently fed through the process of the invention a second time, supported by the collection belt, as the collection surface. In another embodiment of the present invention, a preformed sheet can even be used in the process of the invention as the collection belt itself.

When the material being issued comprises a polymeric material, the gas that is pulled through the collection surface during the process of the present invention can be heated so that a portion of the polymeric material is softened and bonds to itself at points. The gas can be pulled from beyond the ends of the rotor and/or through the rotor itself. Auxiliary gas can be supplied to the cavity between the rotor and the collection surface. When the tangential speed at the periphery of the rotor is greater than about 25% of the issuance speed, the auxiliary gas is advantageously supplied from the rotor itself. The gas is supplied from the rotor by either forcing the gas through the rotor by way of a blower and ductwork, or by incorporating blades into the rotor, or a combination of both. The blades are sized, angled and shaped so as to cause gas flow. Advantageously, the blades are designed so that the amount of gas generated by the rotor is approximately equal to the amount of gas being pulled through the collection surface by the vacuum, and can be somewhat more or less depending on the process conditions. The amount of gas entering the rotor can be controlled by enclosing the space surrounding the rotor and collector, also referred to as the "spin cell," and providing an opening to the rotor in the enclosure which can be varied in size.

The gas that is pulled by vacuum through the collection surface can be heated by passing it through a heat exchanger and then returning it to the rotor.

In one embodiment of the invention in which the material being issued comprises a polymeric fibrous material, the material collected on the collection surface is heated sufficiently to bond the material. This can be accomplished by maintaining the temperature of the atmosphere surrounding the collected material at a temperature sufficient to bond the collected material. The temperature of the material can be sufficient to cause a portion of the polymeric fibrous material to soften or become tacky so that it bonds to itself and the surrounding material as it is collected. A small portion of the polymer can be caused to soften or become tacky either by heating the issued material before it is collected sufficiently to melt a portion thereof, or by collecting the material and immediately thereafter, melting a portion of the collected material by way of the heated gas passing therethrough. In this way, the process of the invention can be used to make a self-bonded nonwoven product, wherein the temperature of the gas passing through the collected material is sufficient to melt or soften a small portion of the collected material (discrete fibrils or discrete fibrils in combination with discrete particles) but not so high as to melt a major portion of the material.

Advantageously, the space surrounding the rotor and collector, or the spin cell, is enclosed so that the temperature and pressure can be controlled. The spin cell can be heated according to any of a variety of well-known means. For example, the spin cell can be heated by a single means or a combination of means including blowing hot gas into the spin cell, steam pipes within the spin cell walls, electric resistance heating, and the like. Heating of the spin cell is one way to ensure good pinning of the polymeric fibrous material to the collection surface, since polymeric fibers become tacky above certain temperatures.

Heating of the spin cell can also enable the production of nonwoven products which are differentially bonded through the thickness thereof. This can be accomplished by forming a product from layers of polymers having different sensitivities to heat relative to each other. For instance, at least two polymers having different melting or softening temperatures can be issued simultaneously from separate nozzles. The temperature of the process is controlled at a temperature greater than the temperature at which the lower melting temperature polymeric material becomes tacky, but lower than the temperature at which the higher melting temperature polymer becomes tacky, thus the lower melting polymer material is bonded and the higher melting polymer material remains unbonded or not completely bonded. In this way, the higher melting temperature polymer fibers are bonded together with the lower melting temperature polymer fibers as they are formed. The nonwoven is bonded at sites uniformly throughout its thickness. The resulting nonwoven has a high delamination resistance.

A self-bonded polymeric nonwoven product can also be formed by issuing a mixture comprising at least two polymers having different melting or softening temperatures. In one embodiment, one of the polymers, preferably constituting a minor proportion by weight of the polymers in the mixture, for instance about 5% to about 10% by weight of the polymers in the mixture, has a lower melting or softening temperature than the remaining polymer(s), and the temperature of the issued material exceeds the lower melting or softening temperature, either immediately prior to the material being collected on the collection surface or immediately after the material is collected, such that the lower melting polymer softens or becomes sufficiently tacky to bond the collected material together.

In one embodiment of the present invention, the material supplied to the nozzle is a mixture comprising at least two polymers having different softening temperatures and the temperature of the atmosphere surrounding the material being collected on the collection surface is maintained at a temperature intermediate the softening temperatures of two of the polymers, so that the lower softening temperature polymer(s) softens and/or becomes tacky, and the issued material bonds into a coherent sheet. For example, the polymers used in this embodiment can be polyethylene (having a melting temperature of 138° C.) and polypropylene (having a melting temperature of 165° C.). In this example, if the process is run at 136° C., the polyethylene will soften and bond the collected material together uniformly throughout its thickness. Depending on the choice of different polymers, temperatures from about 60° C. to about 280° C. can be used.

Various methods can be employed to secure or pin the material to the collector. According to one method, vacuum is applied to the collector from the side opposite the collection surface at a sufficient level to cause the material to be pinned to the collection surface.

As an alternative to pinning the material by vacuum, the material can also be pinned to the collection surface by electrostatic force of attraction between the material and the collector, i.e., between the material and the collection surface, the collecting cylindrical structure, or the collection belt, as the case can be for a particular embodiment of the invention. This can be accomplished by creating either positive or negative ions in the gap between the rotor and the collector while grounding the collector, so that the newly issued material picks up charged ions and thus the material becomes attracted to the collector. Whether to create positive or negative ions in the gap between the rotor and the collector is determined by what is found to more efficiently pin the material being issued.

In order to create positive or negative ions in the gap between the rotor and the collection surface, and thus to positively or negatively charge the solidified issued material passing through the gap, one embodiment of the process of the present invention employs a charge-inducing element installed on the rotor. The charge-inducing element can comprise pin(s), brushes, wire(s) or other element, wherein the element is made from a conductive material such as metal or a synthetic polymer impregnated with carbon. A voltage is applied to the charge-inducing element such that an electric current is generated in the charge-inducing element, creating a strong electric field in the vicinity of the charge-inducing element which ionizes the gas in the vicinity of the element thereby creating a corona. The amount of electrical current necessary to be generated in the charge-inducing element will vary depending on the specific material being processed, but the minimum is the level found to be necessary to sufficiently pin the material, and the maximum is the level just below the level at which arcing is observed between the charge-inducing element and the grounded collection belt. In the case of flash spinning a polyethylene plexifilamentary web, a general guideline is that the material pins well when charged to approximately 8μ-coulombs per gram of web material. Voltage is applied to the charge-inducing element by connecting the charge-inducing element to a power supply. The farther from the collector the material is being issued, the higher the voltage must be to achieve equivalent electrostatic pinning force. In order to apply the voltage generated at the stationary power supply to the charge-inducing elements installed on the spinning rotor, a slip ring can be included within the rotor.

In one preferred embodiment, the charge-inducing elements used are conductive pins or brushes which are directed at the collector and which can be recessed in the rotor periphery so that they do not protrude into the gap between the rotor and the collection surface. The charge-inducing elements are located "downstream" from the nozzles or subsequent to the nozzles, from a stationary vantage point outside the rotor relative to as the rotation of the rotor, so that material is issued from the nozzles and is subsequently charged by the charge-inducing elements.

In an alternate embodiment, the charge-inducing elements are pins or brushes which are installed in the rotor such that they are located tangential to the surface of the rotor and are directed towards the material as it is issued from the nozzles.

When the charge-inducing elements are pins, they preferably comprise conductive metal. One or more pins can be used. When the charge-inducing elements are brushes, they can comprise any conductive material. Alternatively, wire such as piano wire can be used as the charge-inducing element.

In an alternate embodiment of the present invention also in which electrostatic force is used to pin the material, conductive elements such as pins, brushes or wires installed on the rotor are grounded by way of a connection through a slip ring, and the collector belt is connected to the power supply. The collection belt comprises any conductive material that does not generate a back corona, a condition in which gas particles are charged with the wrong polarity, thus interfering with pinning.

In another alternate embodiment of the invention, the collection belt is non-conductive and is supported by a support structure that comprises a conductive material. In this embodiment, the support structure is connected to the power supply and the rotor is grounded.

If positive ions are desired so that the material is positively charged, then a negative voltage is applied to the collector. If negative ions are desired, then a positive voltage is applied to the collector.

In one embodiment of the present invention, a combination of vacuum pinning and electrostatic pinning is used to ensure that the material is efficiently pinned to the collection surface.

If the material is polymeric and is heated sufficiently to self bond, as already described herein, the material may form a coherent sheet or membrane on the collection surface without the application of vacuum or electrostatic forces.

Another means of ensuring that the material is pinned to the collection surface is the introduction of a fogging fluid into the gap between the rotor and the collection surface. In this embodiment, the fogging fluid comprising a liquid is issued from nozzle(s) which can be of the same type as the material-issuing nozzles. Such a nozzle is referred to herein as a "fogging jet." The fogging jets issue a mist of liquid droplets which assist the fibers in laying down on the collection surface. Advantageously, there is one fogging jet for each material-issuing nozzle. The fogging jet is located adjacent the nozzle so that the mist issuing therefrom is introduced directly into the carrying jet issuing from the nozzle and some liquid droplets are entrained with the carrying jet and contact the issued material. The mist of liquid issuing from the fogging jets can also serve to provide added momentum to the issued material and reduce the level of drag that the issued material encounters before laying down on the collection surface.

The ratio of the tangential speed at the periphery of the rotor to the speed of the jet issuing from the nozzle, also referred to herein as the "lay-down/issuance ratio," can be any value up to 1, advantageously between about 0.01 and 1, and even between about 0.5 and 1. The closer these two speeds are to one another, i.e., the closer the lay-down/issuance ratio is to 1, the more evenly distributed and uniform are the layers of collected material. It has been found that the uniformity of the collected material can be improved by reducing the mass throughput per nozzle.

The collection belt speed and the throughput of the rotor can be selected in order to achieve a desired basis weight of the product. The number of nozzles in the rotor and the rotational speed of the rotor are selected to achieve the desired number of layers of the collected material and the thickness of each layer. For a given desired basis weight, there are thus two ways to increase the number of layers: The number of nozzles in the rotor can be increased, while the throughput per nozzle is decreased proportionally in order to keep the basis weight constant; or the rotational speed of the rotor can be increased.

When a polymer solution is flash spun according to the present invention, the concentration of the solution affects the polymer throughput per nozzle. The lower the polymer concentration, the lower the polymer mass throughput. The throughput per nozzle can also be varied by changing the size of the nozzle orifice, as would be apparent to the skilled artisan.

The products made by the process of the invention include porous or continuous membranes formed from discrete fibrils or discrete fibrils in combination with discrete polymer particles. The process of the invention results in a product having surprisingly uniform basis weight. Products having a machine direction uniformity index (MD UI) of less than about 14 $(oz/yd^2)^{1/2}$ (82 $(g/m^2)^{1/2}$) can be made, or less than about 8 $(oz/yd^2)^{1/2}$ (47 $(g/m^2)^{1/2}$), or even less than about 4 $(oz/yd^2)^{1/2}$ (23 $(g/m^2)^{1/2}$), and even less than about 3 $(oz/yd^2)^{1/2}$ (17 $(g/m^2)^{1/2}$). The product is more uniform since each layer of collected material is very thin. Each layer can be as thin as less than or equal to about 50 μm, or even less than or equal to about 25 μm, and even less than or equal to about 1 μm. A great number of thin layers, regardless of the nonuniformities of each layer, results in insensitivity to those nonuniformities, and yields a more uniform product than a product having fewer layers of equivalent uniformity.

Test Methods

The following test methods are employed to determine various reported characteristics and properties herein. ASTM refers to the American Society of Testing Materials. ISO refers to the International Standards Organization. TAPPI refers to Technical Association of Pulp and Paper Industry.

Basis weight (BW) was determined by ASTM D-3776, which is hereby incorporated by reference and reported in $g/m^2$.

Tensile Strength was determined by ASTM D 1682, which is hereby incorporated by reference, with the following modifications. In the test a 2.54 cm by 20.32 cm (1 inch by 8 inch) sample was clamped at opposite ends of the sample. The clamps were attached 12.7 cm (5 inches) from each other on the sample. The sample was pulled steadily at a speed of 5.08 cm/min (2 inches/min) until the sample broke. The force at break was recorded in pounds/inch.

Thickness (TH) was determined by ASTM D177-64, which is hereby incorporated by reference, and is reported in micrometers.

Elongation to Break (also referred to herein as "elongation") of a sheet is a measure of the amount a sheet stretches prior to breaking in a strip tensile test. A 2.54 cm (1 inch) wide sample is mounted in the clamps, set 12.7 cm (5 inches) apart, of a constant rate of extension tensile testing machine such as an Instron table model tester. A continuously increasing load is applied to the sample at a crosshead speed of 5.08 cm/min (2 inches/min) until failure. The measurement is given in percentage of stretch prior to failure. The test generally follows ASTM D 5035-95, which is hereby incorporated by reference.

Density of a sheet material was calculated by multiplying the basis weight of the sheet in $g/m^2$ by 10,000 to arrive at $g/cm^2$ and dividing by the thickness in cm, to arrive at density in $g/cm^3$.

Void Fraction of a polymeric sheet material is a measure of the porosity of the sheet material. Void fraction was calculated as 1 minus the density of the sheet as calculated herein divided by the theoretical density of the polymer, multiplied by 100, and is reported in %.

Frazier Permeability is a measure of air permeability of porous materials and is measured in cubic feet per minute per square foot, and subsequently converted and reported in units of liters/second/square meter. It measures the volume of air flow through a material at a differential pressure of 0.5 inches water (1.25 cm of water). An orifice is mounted in a vacuum system to restrict flow of air through sample to a measurable amount. The size of the orifice depends on the porosity of the material. Frazier permeability, which is also referred to as Frazier porosity, is measured using a Sherman W. Frazier Co. dual manometer with calibrated orifice units in $ft^3/ft^2/min$.

Gurley Hill Porositv (GH) is a measure of the permeability of the sheet material for gaseous materials. In particular, it is a measure of how long it takes a volume of gas to pass through an area of material wherein a certain pressure gradient exists. Gurley-Hill porosity is measured in accordance with TAPPI T-460 OM-88, hereby incorporated by reference, using a Lorentzen & Wettre Model 121D Densometer. This test measures the time required for 100 cubic centimeters of air to be pushed through a 28.7 mm diameter sample (having an area of one square inch) under a pressure of approximately 1.21 kPa (4.9 inches) of water. The result is expressed in seconds that are sometimes referred to as Gurley Seconds.

Mullenburst Bursting Strength was determined by TAPPI T403-85, hereby incorporated by reference, and measured in psi.

Hydrostatic Head (HH) is a measure of the resistance of the sheet to penetration by liquid water under a static load. A 18 cm by 18 cm sample (7 inch by 7 inch) is mounted in a SDL 18 Shirley Hydrostatic head tester (manufactured by Shirley Developments Limited, Stockport, England). Water is pumped against one side of a 102.6 sq. cm. section of the sample at a rate of 60 +/−3 cm per minute until three areas of the sample are penetrated by the water. The hydrostatic head is measured in inches. The test generally follows ASTM D 583, hereby incorporated by reference, which was withdrawn from publication in November, 1976. A higher number indicates a product with greater resistance to liquid passage.

Moisture Vapor Transmission Rate (MVTR) is reported in $g/m^2/24$ hrs and was measured with a Lyssy Instrument using test method TAPPI T-523, hereby incorporated by reference.

Elmendorf Tear Strength is a measure of the force required to propagate a tear cut in a sheet. The average force required to continue a tongue-type tear in a sheet is determined by measuring the work done in tearing it through a fixed distance. The tester consists of a sector-shaped pendulum carrying a clamp that is in alignment with a fixed clamp when the pendulum is in the raised starting position, with maximum potential energy. The specimen is fastened in the clamps and the tear is started by a slit cut in the specimen between the clamps. The pendulum is released and the specimen is torn as the moving clamp moves away from the fixed clamp. Elmendorf tear strength is measured in Newtons in accordance with the following standard methods: TAPPI-T-414 om-88 and ASTM D 1424, which are hereby incorporated by reference. The tear strength values reported for the examples below are each an average of at least twelve measurements made on the sheet.

Delamination Strength of a sheet sample is measured using a constant rate of extension tensile testing machine such as an Instron table model tester. A 1.0 in. (2.54 cm) by 8.0 in. (20.32 cm) sample is delaminated approximately 1.25 in. (3.18 cm) by inserting a pick into the cross-section of the sample to initiate a separation and delamination by hand. The delaminated sample faces are mounted in the clamps of the tester which are set 1.0 in. (2.54 cm) apart. The tester is started and run at a cross-head speed of 5.0 in./min. (12.7 cm/min.). The computer starts picking up force readings after the slack is removed in about 0.5 in. of crosshead travel. The sample is delaminated for about 6 in. (15.24 cm) during which 3000 force readings are taken and averaged. The average delamination strength is the average force divided by the sample width and is expressed in units of N/cm. The test generally follows the method of ASTM D 2724-87, which is hereby incorporated by reference. The delamination strength values reported for the examples below are each based on an average of at least twelve measurements made on the sheet.

Opacity is measured according to TAPPI T-425 om-91, which is hereby incorporated by reference. The opacity is the reflectance from a single sheet against a black background compared to the reflectance from a white background standard and is expressed as a percent. The opacity values reported for the examples below are each based on an average of at least six measurements made on the sheet.

Spencer Puncture Resistance is measured according to ASTM D 3420, which is hereby incorporated by reference, and measures the energy required to puncture the sample. The Spencer Puncture is measured in $in\text{-}lb/in^2$. The apparatus, falling pendulum type tester modified with Spencer impact attachment model 60-64, is made by Thwing-Albert Instrument Co.

Machine Direction Uniformity Index (MD UI) of a sheet is calculated according to the following procedure. A beta thickness and basis weight gauge (available from Honeywell-Measurex, Cupertino, Calif.) scans the sheet and takes a basis weight measurement every 0.2 inches across the sheet in the cross direction (CD). The sheet then advances 0.425 inches in the machine direction (MD) and the gauge takes another row of basis weight measurements in the CD. In this way, the entire sheet is scanned, and the basis weight data is electronically stored in a tabular format. The rows and columns of the basis weight measurements in the table correspond to CD and MD "lanes" of basis weight measurements, respectively. Then each data point in column 1 is averaged with its adjacent data point in column 2; each data point in column 3 is averaged with its adjacent data point in column 4; and so on. Effectively, this cuts the number of MD lanes (columns) in half and simulates a spacing of 0.4 inch between MD lanes instead of 0.2 inch. In order to calculate the uniformity index (UI) in the machine direction ("MD UI"), the UI is calculated for each column of the averaged data in the MD. The UI for each column of data is calculated by first calculating the standard deviation of the basis weight and the mean basis weight for that column. The UI for the column is equal to the standard deviation of the basis weight divided by the square root of the mean basis weight, multiplied by 100. Finally, to calculate the overall machine direction uniformity index (MD UI) of the sheet, all of the UI's of each column are averaged to give one uniformity index. Uniformity Index is reported here in $(\text{grams per square meter})^{1/2}$.

EXAMPLE 1

A membrane comprising discrete fibrils was formed by flash-spinning a polymeric solution of 1% Mat 8 high density polyethylene (HDPE) (obtained from Equistar Chemicals LP) in a spin agent of Freon® 11 trichlorofluoromethane (obtained from Palmer Supply Company) at a temperature of 190° C. and a filter pressure upstream of the letdown orifice of 2080-2200 psi (14-15 MPa) through a nozzle in a rotor rotating at 1000 rpm. The rotor used in Examples 1-4 and Examples 6-7 had a diameter of 16 inches (41 cm) and a height of 3.6 inches (9.2 cm). The nozzle used in Example 1 comprised a letdown orifice having a diameter of 0.025 inch (0.064 cm) and a length of 0.038 inch (0.096 cm) which opened to a letdown chamber. The letdown chamber led to a spin orifice having a diameter of 0.025 inch (0.064 cm) and a length of 0.080 inch (0.20 cm). The outlet slot of the nozzle was parallel with the axis of the rotor. The flash spun material was discharged from the nozzle in the radial direction away from the rotor. The flash spun material in the form of fibrils was spun onto a leader sheet of white Sontara® fabric (available from E. I. du Pont de Nemours and Company, Inc.) positioned on a porous collection belt. The distance between the outlet of the nozzle and the collection belt was 3 inches (7.5 cm). The rotor was enclosed in a spin cell and the interior of the spin cell was maintained at a temperature of 60° C.

Electrostatic force was generated from needles spaced evenly in a row just downstream of the nozzle. Each nozzle was grounded through the rotor. The needles therefore were also grounded through the rotor. The collection belt was electrically isolated and brought to a negative voltage. The power supply was run in current control mode, thus the current remained steady at 0.30 mA.

Vacuum was applied to the collection belt by means of a vacuum blower at a speed of 0-1000 RPMs in fluid communication with the collection belt via ductwork. Electrostatic force and vacuum were employed simultaneously to assist with the pinning of the flash spun web to the collector.

It was observed that there were no pinholes in a sample of the membrane. The thickness of the sample was measured to be 0.001 inch (25 μm). A single layer sample of the collected material was bonded by hot-press bonding at 142° C. for 2 sec at 18,000 psi (120 MPa). The basis weight was measured to be 0.44 oz/yd$^2$ (15 g/m$^2$). The Frazier air permeability was measured to be 2.7 cfm/ft$^2$ (0.82 m$^3$/min/m$^2$). The machine direction uniformity index (MD UI) of the sample was measured to be 1.08 (oz/yd$^2$)$^{1/2}$ (6.3 (g/m$^2$)$^{1/2}$), and the cross direction uniformity index (CD UI) of the sample was measured be 1.98 (oz/yd$^2$)$^{1/2}$ (11 (g/m$^2$)$^{1/2}$).

EXAMPLE 2

A membrane comprising discrete fibrils and polymer particles was formed by flash-spinning a 0.5% polymeric solution of 96% Mat 8 HDPE (obtained from Equistar Chemicals LP) and 4% blue HDPE in a spin agent of Freon® 11 trichlorofluoromethane (obtained from Palmer Supply Company) at a temperature of 170-180° C. and a filter pressure upstream of the letdown orifice of 2150-2200 psi (15 MPa) through a nozzle in a rotor rotating at 1000 rpm onto a leader sheet of white Sontara® fabric (available from E. I. du Pont de Nemours and Company) positioned on a porous collection belt. The nozzle comprised a letdown orifice having a diameter of 0.025 inch (0.064 cm) and a length of 0.080 inch (0.20 cm) which opened to a letdown chamber. The letdown chamber led to a spin orifice having a diameter of 0.025 inch (0.064 cm). The distance between the outlet of the nozzle and the collection belt was 1.5 inches (3.7 cm). The rotor was enclosed in a spin cell and the interior of the spin cell was maintained at a temperature of 60° C.

Electrostatic force was generated from needles spaced evenly in a row just downstream of the nozzle. Each nozzle was grounded through the rotor. The needles therefore were also grounded through the rotor. The collection belt was electrically isolated and brought to a negative voltage. The power supply was run in current control mode, thus the current remained steady at 0.20 mA.

Vacuum was applied to the collection belt by means of a vacuum blower at a speed of 2000 RPMs in fluid communication with the collection belt via ductwork. Electrostatic force and vacuum were employed simultaneously to assist with the pinning of the flash spun web to the collector.

A very uniform membrane layer of fibrils and particles was deposited upon the Sontara® leader sheet. A photomicrograph of the cross-section of a sample is shown in FIG. 4, illustrating the randomly convoluted cross-section of the polymeric fibrils deposited on the Sontara® leader sheet (indicated by the round cross-section fibers). The Sontara® leader sheet alone had a basis weight of 2.08 oz/yd$^2$ (70 g/m$^2$) and a Frazier air permeability of 92 CFM per square feet (0.63 m$^3$/min/m$^2$). With the membrane layer, the leader sheet had a basis weight is 2.50 oz/yd$^2$ (85 g/m$^2$), a Gurley Hill porosity of 11.5 seconds and a hydrostatic head of 22 inches (56 cm) of water. The thickness of the membrane layer was about 35 μm.

EXAMPLE 3

A membrane comprising discrete fibrils and polymer particles was formed by flash-spinning a polymeric solution of 4% Tefzel® ETFE (ethylene-tetrafluoroethylene copolymer) (available from E. I. du Pont de Nemours and Company) in a spin agent of Freon® 11 trichlorofluoromethane (obtained from Palmer Supply Company) at a temperature of 210° C. and a filter pressure upstream of the letdown orifice of 2160-2340 psi (15-16 MPa) through two nozzles having dimensions as described in Example 1 in a rotor rotating at 1000 rpm onto a leader sheet of Typar® fabric (available from E. I. du Pont de Nemours and Company) positioned on a porous collection belt. The outlet slots of the nozzles were oriented at angles of +20° and −20° relative to the axis of the rotor. The flash spun material was discharged from the nozzle in the radial direction away from the rotor. The distance between the outlet of the nozzle and the collection belt was 1 inch (2.5 cm). The rotor was enclosed in a spin cell and the interior of the spin cell was maintained at a temperature of 60° C.

Electrostatic force was generated from needles spaced evenly in a row just downstream of the nozzle. Each nozzle was grounded through the rotor. The needles therefore were also grounded through the rotor. The collection belt was electrically isolated and brought to a negative voltage. The power supply was run in manual mode, thus the current was continuously adjusted to ensure good laydown of the collected material. The collected material was laid down very uniformly until the electrostatic force was turned off whereupon the sample came off the Typar® leader sheet.

Vacuum was applied to the collection belt by means of a vacuum blower at a speed of 2000 RPMs in fluid communication with the collection belt via ductwork. Electrostatic force and vacuum were employed simultaneously to assist with the pinning of the flash spun web to the collector.

The collected material had a surface area of 3.6 m$^2$/g, a basis weight of 0.17 oz/yd$^2$ (5.8 g/m$^2$) and a thickness of less than 20 μm. A sample of the collected material was found to have a Frazier air permeability of 53 CFM per square foot (16 m$^3$/min/m$^2$) and a hydrostatic head of 5.3 inches (13 cm) of water.

EXAMPLE 4

A membrane comprising discrete fibrils was formed by flash-spinning a polymeric solution of 2% Mat 6 HDPE (obtained from Equistar Chemicals LP) in a spin agent of Freon® 11 trichlorofluoromethane (obtained from Palmer Supply Company) at a temperature of 180° C. and a filter pressure upstream of the letdown orifice of 1790-1960 psi (12-13 MPa) through a nozzle having dimensions as described in Example 1 in a rotor rotating at 500 rpm onto a leader sheet of white Reemay® spunbonded polyester fabric (available from BBA Nonwovens) positioned on a porous collection belt. The flash spun material was discharged from the nozzle in the radial direction away from the rotor. The distance between the outlet of the nozzle and the collection belt was 1 inch (2.5 cm). The rotor was enclosed in a spin cell and the interior of the spin cell was maintained at a temperature of 80° C.

Vacuum was applied to the collection belt by means of a vacuum blower at a speed of 2000 RPMs in fluid communication with the collection belt via ductwork to assist with the pinning of the flash spun material to the collector.

A sample of the collected material had a surface area of 2.0 m$^2$/g, a basis weight of 0.32 oz/yd$^2$ (11 g/m$^2$), and a thickness of 1.8 mil (46 μm). The sample had a MD UI of 3.3 (oz/yd$^2$)$^{1/2}$ (19 (g/m$^2$)$^{1/2}$), and a CD UI of 4.2 (oz/yd$^2$)$^{1/2}$ (24 (g/m$^2$)$^{1/2}$).

A sample of the collected material was hot press bonded at 140° C. for 2 seconds. It was found to have a tensile strength in the MD of 1.5 lb/in (2.6 N/cm) and in the CD of 0.45 lb/in (0.78 N/cm), and an elongation of 21% in the MD and 61% in the CD.

EXAMPLE 5

A sample comprising a deposited layer of cellulose and polymeric discrete fibrils on the surface of an unbonded flash-spun sheet of plexifilamentary film-fibril HDPE material was formed by spinning a combination of 1% by weight BH600/20 Apha-Cel food grade cellulose (obtained from International Fiber Corp.) and 0.5% by weight Mat 8 HDPE (obtained from Equistar Chemicals LLP) in a spin agent of Freon® 11 trichlorofluoromethane (obtained from Palmer Supply Company) at a temperature of 170-180° C. in the filter pressure upstream of the letdown orifice 1500 psi (10 MPa) through five nozzles having dimensions as described in Example 1 in a spinning beam containing passages distributing the solution to the nozzles onto a sheet of unbonded plexifilamentary film-fibril elements (available from E. I. du Pont de Nemours and Company) positioned on a porous collection belt. The distance between the outlet of the nozzle and the collection belt was 3 inches (7.5 cm).

Vacuum was applied to the collection belt by means of a vacuum blower at a speed of 2000 RPMs in fluid communication with the collection belt via ductwork.

Electrostatic force was generated from needles spaced evenly in a row just downstream of the nozzle. Each nozzle was grounded through the rotor. The needles therefore were also grounded through the rotor. The collection belt was electrically isolated and brought to a negative voltage. The power supply was run in current control mode, thus the current remained steady at 0.30 mA.

The resulting deposited layer had a basis weight of 0.24 oz/yd$^2$ (8.1 g/m$^2$).

A resulting sample of the deposited layer of cellulose and discrete fibrils on the unbonded flash-spun sheet was subjected to test method ISO 15416, "Bar Code Print Quality Guideline," which measures the quality parameters of a printed bar code symbol. Five separate samples were tested 10 times each, and the average of the quality parameters was about 2.7 which equates to a grade of a high "C" on the grading scale of "A" to "F" for suitability as a barcode printing substrate.

EXAMPLE 6

A sample comprising fibrils was formed by flash spinning a 4% solution of a combination of 80% Mat 6 HDPE (obtained from Equistar Chemicals LLP) and 20% Engage® 8407 polyolefin elastomer (obtained from DuPont Dow Elastomers LLC, Wilmington, Del.) in a spin agent comprising a combination of about 6% Vertrel® HFC-43-10 mee (available from E. I. du Pont de Nemours and Company, Inc.) and 94% dichloromethane at a temperature of 175-185° C. and a filter pressure upstream of the letdown orifice of 800-1900 psi (5-13 MPa). The solution was fed to two nozzles, comprising spinning orifices opening to fan jets, in a rotor rotating at 500 rpm. Each nozzle comprised a letdown orifice having a diameter of 0.025 inch (0.064 cm) and a length of 0.032 inch (0.081 cm) which opened to a letdown chamber. The letdown chamber led to a spin orifice having a diameter of 0.025 inch (0.064 cm) and a length of 0.080 inch (0.20 cm). The flash-spun material was spun onto a woven black nylon belt (obtained from Albany International). The flash spun material was discharged from the nozzle in the radial direction away from the rotor. The distance between the outlet of the nozzle and the collection belt was 0.38 inch (1 cm). The rotor was enclosed in a spin cell and the interior of the spin cell was maintained at a temperature of 106-107° C. The stem cell temperature caused the polyolefin elastomer to soften and become tacky, thereby self-bonding the collected material.

An aerodynamic stainless steel foil extending 0.62 inch (1.6 cm) from the face of the nozzle in the radial direction was installed on the periphery of the rotor adjacent the outlet slot of the nozzle on the upstream side of the nozzle. The foil was used to ensure that the jet velocity remained high after leaving the nozzle. The foil was installed at a 45° angle to the radial direction.

Vacuum was applied to the collection belt by means of a vacuum blower at a speed of 2500 RPMs in fluid communication with the collection belt via ductwork to assist with the pinning of the flash spun material to the collection belt.

Electrostatic force was generated from needles spaced evenly in a row just downstream of the nozzle. Each nozzle was grounded through the rotor. The needles therefore were also grounded through the rotor. The collection belt was electrically isolated and brought to a negative voltage. The power supply was run in current control mode, thus the current remained steady at 0.42 mA.

The resulting deposited layer had a basis weight of 0.97 oz/yd$^2$ (33 g/m$^2$), a thickness of 3.7 mills (94 μm) and a surface area of 0.52 m$^2$/g. The deposited layer had a MD UI of 18 (oz/yd$^2$)$^{1/2}$ (104 (g/m$^2$)$^{1/2}$), and a CD UI of 4.0 (oz/yd$^2$)$^{1/2}$ (23 (g/m$^2$)$^{1/2}$). It was observed that the collection belt speed varied, resulting in a higher MD UI.

EXAMPLE 7

A membrane comprising fibrils and polymer particles was formed by flash-spinning a dispersion of 0.5% Mat 8 HDPE (obtained from Equistar Chemicals LP) in a spin agent of Freon® 11 trichlorofluoromethane (obtained from Palmer Supply Company) through a spinning beam containing passages distributing the dispersion to a set of 4 nozzles having dimensions as described in Example 1.

The dispersion was flash spun through the fan jets onto a collection substrate of metallized Mylar® (available from DuPont Teijin Films, Hopewell, Va.). The dispersion was flash spun at a temperature of between 176° C. and 179° C. and a filter pressure upstream of the letdown orifice of 1440-1900 psi (10-13 MPa). The Mylar® collection substrate and the collected material were conveyed by a moving porous collection belt. The distance between the outlet of the nozzles and the collection belt was 3 inches (7.6 cm), at which distance the fluid jets were in substantially laminar flow.

Vacuum was applied to hold the Mylar® to the collection belt by means of a vacuum blower at a speed of 1000 RPMs in fluid communication with the collection belt via ductwork. The polymeric particles were sufficiently tacky to adhere to the Mylar® without any other apparent pinning force.

A layer of HDPE fibrils and particles was deposited onto the surface of the metallized Mylar® substrate, the deposited layer having a basis weight of 0.4 oz/yd$^2$ (14 g/m$^2$) and a thickness of 0.001 inch (25 μm).

The invention claimed is:

1. A process for forming a membrane material comprising the steps of:

(a) supplying a fluidized mixture comprising a spin agent and at least two polymers having different melting or softening temperatures at a pressure greater than atmospheric pressure to a rotor spinning about an axis at a rotational speed, the rotor having at least one material-issuing nozzle comprising an opening therein along the periphery of the rotor;

(b) issuing the fluidized mixture from the opening of the nozzle into an environment at atmospheric pressure to form an issued material at a material issuance speed;

(c) vaporizing or expanding at least one component of the issued material to form a fluid jet;

(d) transporting the remaining component(s) of the issued material away from the rotor by the fluid;

(e) collecting the remaining component(s) of the issued material on a collection surface of a collection belt concentric to the axis of the rotor to form a collected material, the collection belt moving in a direction parallel to the axis of rotation of the rotor at a collection belt speed; and (f) maintaining the temperature of the collected material at a temperature greater than the temperature of the lowest melting or softening temperature polymer for a sufficient time to render the lowest melting or softening temperature polymer tacky, wherein a preformed sheet, selected from the group consisting of nonwoven sheet, woven sheet and film, is provided on the moving collection belt and the remaining component(s) of the issued material are collected on the surface of the preformed sheet, and wherein the collected material forms a membrane layer on the surface of the preformed sheet and the membrane layer has a thickness of less than 50 μm and a machine direction uniformity of less than 23 $(g/m^2)^{1/2}$.

2. The process of claim 1 wherein the membrane layer has a thickness of less than or equal to 25 μm and a machine direction uniformity of less than 17 $(g/m^2)^{1/2}$.

3. The process of claim 1 wherein the membrane layer has a thickness of less than or equal to 1 μm.

4. The process of claim 1 further comprising calendering the collected material and the preformed sheet at a temperature and pressure sufficient to render the collected material nonporous, and removing the collected material from the preformed sheet to form a membrane.

5. A process for forming a material membrane comprising discrete polymeric fibrils or a combination of discrete fibrils and discrete polymeric particles, the process comprising the steps of:

(a) supplying the fluidized mixture comprising a solution of a polymer in a spin agent at a concentration of about 0.5% by weight to about 5% by weight at pressures greater than atmospheric pressure to a rotor spinning about an axis at a rotational speed, the rotor having a material-issuing nozzle comprising an opening therein along the periphery of the rotor;

(b) issuing the fluidized mixture from the opening of the nozzle into an environment at atmospheric pressure to form an issued material at a material issuance speed;

(c) vaporizing or expanding at least one component of the issued material to form a fluid jet;

(d) transporting discrete fibrils or combination of discrete fibrils and discrete polymeric particles formed from the remaining component(s) of the issued material away from the rotor by the fluid; and (e) collecting the discrete fibrils or combination of discrete fibrils and discrete polymeric particles on a collection surface of a collection belt concentric to the axis of the rotor to form a membrane having a thickness of less than about 50 μm, the collection belt moving in a direction parallel to the axis of rotation of the rotor at a collection belt speed.

6. The process of claim 5 wherein the membrane has a machine direction uniformity of less than 23 $(g/m^2)^{1/2}$.

7. The process of claim 5 wherein the membrane has a thickness of less than or equal to 25 μm and a machine direction uniformity of less than 17 $(g/m^2)^{1/2}$.

8. The process of claim 5 wherein the membrane has a thickness of less than or equal to 1 μm.

* * * * *